US005240129A

United States Patent [19]

Schrick et al.

[11] Patent Number: 5,240,129

[45] Date of Patent: Aug. 31, 1993

[54] HEAVY DUTY CRANE WITH SELF-RETRACTING/ERECTING LIVE MAST

[75] Inventors: Michael H. Schrick; Donald E. Moore, both of Lexington, Ky.

[73] Assignees: Link-Belt Construction Equip. Co., Lexington, Ky.; Sumitomo Construction Machinery, Japan; a part interest to each

[21] Appl. No.: 532,873

[22] Filed: Jun. 4, 1990

[51] Int. Cl.[5] ..... B66C 23/00

[52] U.S. Cl. ..... 212/175; 212/177; 212/186; 212/188; 212/233

[58] Field of Search ..... 212/175, 177, 179-186, 212/188, 227, 231-233, 235, 236-239, 244, 255, 260-263, 265; 52/115-119

[56] References Cited

U.S. PATENT DOCUMENTS

| | | | |
|---|---|---|---|
| 2,740,535 | 4/1956 | Bill . | |
| 2,786,580 | 3/1957 | Balogh . | |
| 2,828,064 | 6/1958 | Brown . | |
| 2,838,182 | 6/1958 | Brown . | |
| 2,897,979 | 8/1959 | Holan et al. . | |
| 3,071,255 | 1/1963 | Bill | 212/236 |
| 3,146,893 | 9/1964 | Eckels et al. . | |
| 3,664,516 | 5/1972 | Goudy | 212/186 |
| 3,769,375 | 1/1973 | Morrison et al. | 212/236 |
| 3,842,983 | 10/1974 | Dolza | 212/236 |
| 4,053,058 | 10/1977 | Jensen et al. | 212/186 |
| 4,081,081 | 3/1978 | Morrow, Sr. et al. | 212/186 |
| 4,352,434 | 10/1982 | Poock | 212/186 |
| 4,467,928 | 8/1984 | White . | |
| 4,492,312 | 1/1985 | Poock | 212/264 |
| 4,579,234 | 4/1986 | Delago et al. | 212/178 |

FOREIGN PATENT DOCUMENTS

| | | | |
|---|---|---|---|
| 2525867 | 2/1976 | Fed. Rep. of Germany | 212/186 |
| 594021 | 2/1978 | U.S.S.R. | 212/236 |
| 1409577 | 7/1988 | U.S.S.R. | 212/186 |
| 931739 | 7/1963 | United Kingdom | 212/186 |

*Primary Examiner*—Joseph F. Peters, Jr.
*Assistant Examiner*—Kenneth Lee
*Attorney, Agent, or Firm*—King & Schickli

[57] ABSTRACT

A traveling crane incorporates a self-retracting/erecting live mast or the like, pivotally mounted on the base unit and capable of moving to and from a flipped, stowed position on the opposite side of vertical from the positions of the normal operating mode. A cable and winch is provided to raise and lower the mast during the normal operating mode and to move the mast toward the stowed position. A power cylinder operates to control the mast during retraction and to erect the mast from the stowed position. A control system operates the power cylinder to controllably move the mast during retraction/erection. Flexible pendants and telescopic guide links interconnect the cylinder with the mast and the base unit. Optimum operating angles are provided. The control system includes an electrical circuit and a hydraulic circuit, the hydraulic circuit having a restricted orifice to resist movement of the mast by gravity during retraction. The electrical circuit includes interlocks to disable the cable and winch at a selected angle and to place the cylinder in a free float mode during normal crane operation. The method includes the steps of pivotally moving the mast with the cable and winch, engaging the mast by the power cylinder during retraction/erection and counterbalance controlling the mast movement.

14 Claims, 6 Drawing Sheets

HEAVY DUTY CRANE WITH SELF-RETRACTING/ERECTING LIVE MAST

BACKGROUND OF THE INVENTION

The present invention relates to a crane having a live mast or the like, and more particularly, to a heavy duty, traveling crane wherein the mast is capable of self-retracting/erecting so that the crane is operable on a completely self-contained basis.

Cranes that are mounted on a truck bed for over the road travel are very popular. A construction company, sign company or similar service business can make very efficient use of their capital equipment by being able to quickly move their crane from one construction site to another. In the past, light to medium duty cranes have enjoyed wide popularity in this respect. Also, in recent years, heavy duty cranes are likewise being mounted on over the road vehicle chassis to handle the very heaviest loads at the construction sites and the like. However, in the past, one of the restrictions involving the heavy duty, traveling cranes has been the need for having an attending light duty crane to assist in erecting the live mast from the stowed position and other make-ready functions, such as assembling/disassembling a multi-section boom.

For making modern day heavy duty traveling cranes capable of lifting maximum loads, the base unit of the crane is constructed as large and heavy as possible, subject only to the restrictions of over the road travel. It is desirable to have the maximum width for greater stability, and the maximum counterweight attached to the base in order to be capable of raising the heaviest loads to the highest heights.

With the counterweight mounted on the crane base, and remaining intact during the over the road travel, it has been found that the only practical way of balancing the weight of the entire vehicle over the multiple axles in order to meet highway weight regulations is to store the live mast in a flipped position over the cab of the tractor. Short of removing the counterweight and otherwise disassembling parts of the crane, including actual removal of the pivoted mast for travel, the only practical answer has been to use the separate, attending crane for flipping the mast.

In a typical crane for light/medium duty, a different type of arrangement has been necessary in the past as shown for example in the U.S. Pat. No. 4.467,928, to White, issued Aug. 28, 1984 and assigned to the present applicant. In the '928 patent, this medium duty crane with an extensible boom includes a mast that has no way of being stowed for travel except by rotation of the base unit on the turntable (see FIG. 2 of the '928 patent). This arrangement avoids the necessity of a separate, attendant crane but severely limits the load rating of the crane since the base has to be rotated 180° from the operating position. As can be realized by viewing FIG. 2, this arrangement for the heavy duty crane places an overload on the rear axles of the vehicle, especially when considering the substantial counterweight unit that is required on the back of the base unit. U.S. Pat. No. 4,352,434, issued Oct. 5, 1982 approaches the problem in the same manner. It can be seen in this arrangement that a relatively complicated series of cables, sheaves and winches are required, along with a very complicated procedure for lowering the boom and live mast to the traveling position. Even with this complicated arrangement, the load capability of the crane is restricted.

Previously, in very light duty cranes, there have been proposals for stowing the boom over the cab of the vehicle by using a single power cylinder or the like and a complicated rear mounted linkage. These prior art approaches are typified by the structure shown in the Eckles et al. U.S. Pat. No. 3,146,893, issued Sep. 1, 1964. Alternatively, to accomplish this result, the pivotal mounting of the boom must be disconnected during the stowing procedure. This is shown in the Brown U.S. Pat. No. 2,838,182, issued Jun. 10, 1958.

Thus, a need for an improved operating and stowage arrangement and procedure is identified. This is particularly needed for the heavy duty/traveling crane where the live mast, boom or the like is to be flipped to a stowed position over or adjacent the cab of the vehicle. This is to be accomplished without a separate, attendant crane being on site and needs to be carried out with speed and efficiency.

SUMMARY OF THE INVENTION

Accordingly, it is a primary object of the present invention to provide a crane overcoming the limitations of the prior art with respect to stowage of the live mast or the like in a flipped, stowed position on the opposite side of vertical from the positions of the normal operating mode of the crane.

It is another object of the present invention to provide a self-retracting/erecting apparatus and related method for stowing of a pivoted mast utilizing the cable and winch and a hydraulic power cylinder with counterbalance controls.

Another object of the present invention is to provide a crane with a mast or the like that may be retracted-/erected/operated on a self-contained basis with the mast being stowed in a flipped position providing over the road travel with improved axle loading.

Another object of the present invention is to provide a crane operating system and method wherein a power cylinder, flexible pendant and guide link combination is used to provide counterbalance movement of the mast to the stowed position and also to erect the mast to the operating position.

Still another object of the present invention is to provide a crane apparatus and method wherein the counterbalancing operation of the pivotal mast is provided by forcing hydraulic fluid from a power cylinder through a restricted orifice in a counterbalance valve.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved crane apparatus is provided having a capability for self-retracting/erecting of a live mast or the like, as well as operation in an efficient manner on a self-contained basis. The crane of the present invention is particularly adapted for a heavy duty, over the road model wherein the vertically pivotal base unit with the heavy counterweight remains in the operating position during the over the road travel.

The mast is conveniently moved to and from a flipped, stowed position forwardly with respect to the vehicle and over the vehicle cab. While the present invention will thus be described in the preferred embodiment illustrated with respect to a live mast for a crane, it will be recognized that the same approach can be utilized for the boom of a crane or the like with equal efficiency.

As shown in the preferred embodiment, a pivotal mast is mounted on the vertically pivotal turntable and base unit and is operated for raising and lowering during the normal operating mode by a power cable and winch combination forming a first power means. Also, the first power means is operative to move the mast toward the stowed position in the forward direction with respect to the vehicle movement so as to be positioned over the cab of the vehicle. A second power means engages the mast for control and operation in the positions of the retraction/erection mode. In the preferred embodiment, this takes the form of a hydraulic power cylinder. Counterbalance control means operates the second power means to controllably move the mast along the positions of the retraction/erection mode. As can be recognized, the mast may thus be retracted/erected/operated on a self-contained basis.

It can be recognized that the combination of the present invention provides a simplified, but highly effective concept for maximum control of the mast or the like, but at the same time providing maximum efficiency and speed of retraction/erection/operation. The concept provides for relatively low cost of manufacture and maintenance by using standard system components. The cable and winch used for normal operation of the live mast is complemented by the power cylinder providing the counterbalance control. In addition, the power cylinder provides for erection of the mast from the flipped position, thus eliminating the need for additional power cables. During operation of the crane for lifting loads, and is will be seen more in detail later, the cylinder is shifted to a free float mode that does not interfere with the operation, but indeed tends to stabilize and perform some shock absorbing function. A compression spring on the base of the cylinder provides a complementary and full time shock absorbing function. The ease of operation, which will also be described more in detail, insures that with a minimum of training, an operator becomes highly skilled and efficient.

The power cylinder is connected to the mast by a pendant and first and second pivot connectors so as to permit relative flexing at both the mast and the cylinder. In order to guide and stabilize the cylinder, a telescopic guide link means is pivotally mounted on the base unit and attached to a cross bar to which the cylinder and the second pivot connector is attached. This combined pendant/guide link mounting provides for ideal interaction allowing the required relative angular movement during retraction/erection, as well as during normal crane operation. With the flexibility and pivotal connections, the pendant moves relative to the power cylinder and actually crosses over center of the power cylinder allowing the full retraction of the mast. During erection, the pendant is used to lift the mast from the forward position over the cab of the vehicle when the cylinder is provided with pressurized fluid.

The telescopic guide link establishes a maximum fixed arc from approximately 125° to 50° angle from the horizontal position of the mast in the operating mode. At the other extreme of operation, the guide link establishes a minimum fixed arc from approximately 174° to 155° angle. The full stowage position of the mast is at the 174° angle.

The control of the mast is preferably provided by novel control system incorporating a hydraulic circuit and an electrical circuit. In accordance with an important feature of the present invention, this control system is operative to actuate a counterbalance valve to position a restricted orifice in the hydraulic circuit to limit hydraulic fluid flow from the cylinder. This provides an ideal resistance to the movement of the mast during the retraction mode. During retraction, gravity is acting on the mast to take it to the stowed position, and in addition the cable and winch may be activated to assure smooth movement and take up of the cable slack. As a result, enhanced control of the mast is provided.

The electrical control circuit includes a first interlock means to disable the winch and cable power means as the mast approaches the stowed position. This prevents the cable from being inadvertently operated and causing possible damage to the system.

As indicated above, the flexible pendant, the power cylinder and the guide link all connect to the cross bar, that in turn is attached to the boom by a bracket during normal load lifting operation of the crane. When the boom is being operated, it is desirable for the hydraulic circuit to be locked out. Accordingly, an interlock switch providing a free float mode to the cylinder is provided on the bracket. A latch means is provided on the bracket for firmly holding the cross bar.

In the preferred embodiment, the crane includes a wheeled vehicle for support. Because the mast can be pivoted forwardly with respect to the vehicle and the counterweight of the base unit can be maintained toward the forward axles, balancing of the load among the multiple axles of the vehicle is easily accomplished. Similarly, the cab for the operator of the crane remains facing rearwardly of the vehicle movement, or toward the direction of the normal operation mode. In essence, the entire mechanical structure lends itself to the ease of conversion to or from the transport mode.

In the related method of operating the crane, the mast is first pivotally moved with respect to the base unit by the first power means; namely, the cable and winch. This operation allows for both raising and lowering the live mast during the normal operating sequence, but also is operative to move the mast toward the stowed position. The mast is engaged by the second power means, that is the hydraulic power cylinder, in the positions of the retraction/erection mode. At all times, the mast maintains its pivoting action on the base unit. In accordance with the invention, counterbalance control of the movement of the mast is provided by the cylinder as the mast moves along the positions of the retraction/erection mode. These steps serve to allow the mast to be retracted/erected/operated in a very efficient and on a self-contained basis.

Counterbalance controlling is preferably accomplished by forcing hydraulic fluid through a restricted valve. The control step is preferably started at the 50° position from the horizontal operating position. Also included in the operation is the step of pressurizing the power cylinder to erect the mast. In order to maintain the stability of the mast movement, the power cylinder remains attached to the first section of the boom and the power cylinder is maintained in the free float operational mode during normal pivotal movement of the mast.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 4 is a section taken along lines 4—4 of FIG. 5, and illustrating the dual guide links and flexible pendants connected to the cross bar, all mounted on the turntable of the base unit;

Reference will now be made in detail to the present preferred embodiment of the invention, an example of which is illustrated in the accompanying drawing.

DETAILED DESCRIPTION OF THE INVENTION

Figure 1:
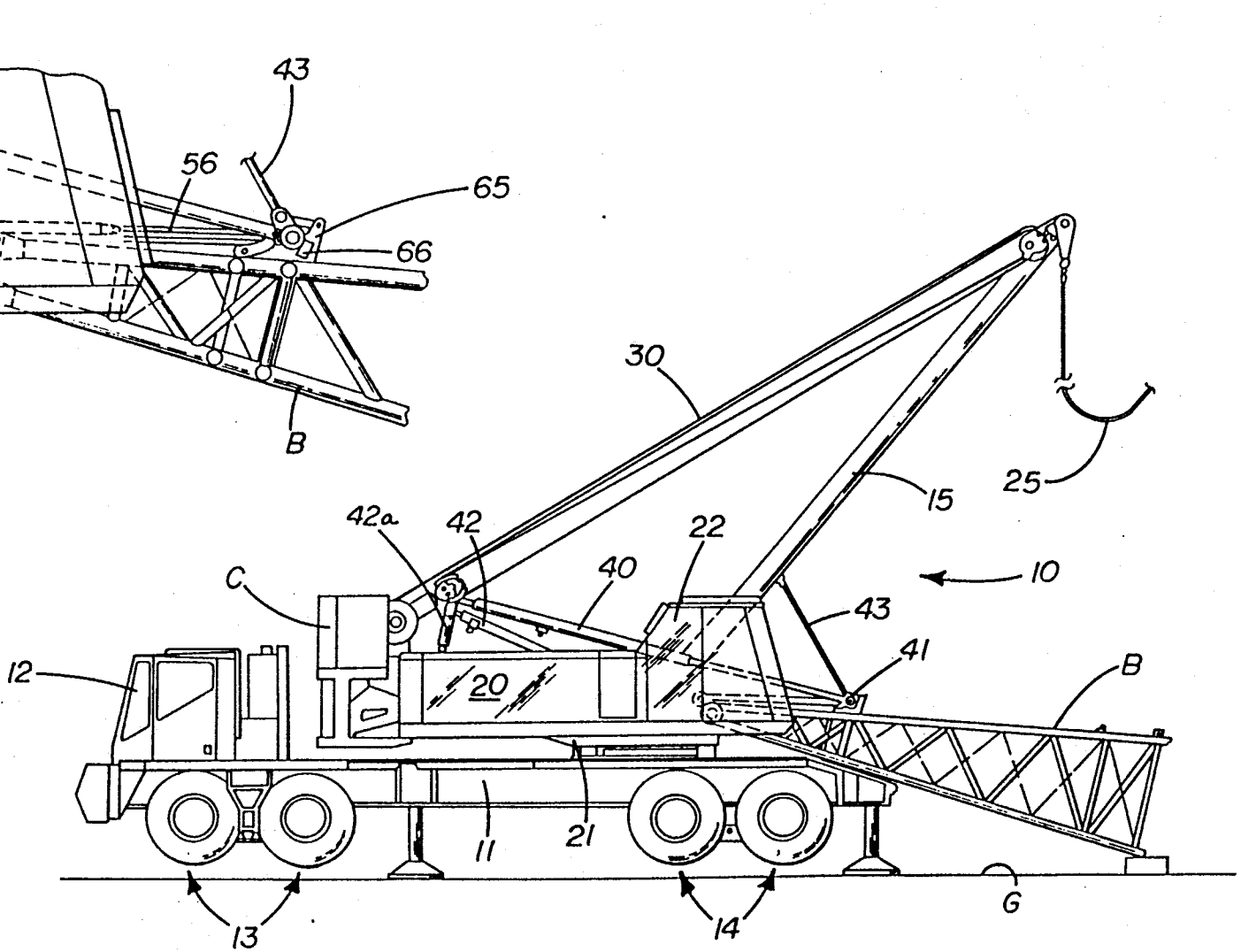
FIG. 1 is an overall side view of a crane built in accordance with the present invention.

Reference is now made to FIG. 1 of the drawings showing an entire crane 10 constructed in accordance with the present invention. A truck chassis 11 having a driver cab 12 provides over the road transport capability. In the particular set-up shown, the vehicle includes four load bearing axles; two forward axles 13 and two rearward axles 14. In accordance with the invention, the crane 10 can be easily converted for transporting between construction or other service sites. Advantageously, when placed in the transport mode, as will be seen in detail later, substantial equal loading of the axles 13, 14 is accomplished. This is performed with overall efficiency and ease that is unparalleled in the prior art. For the first time, an over the road heavy duty crane is provided that can easily move from site to site without the assistance of a separate, attendant light crane.

Figures 3, 13:
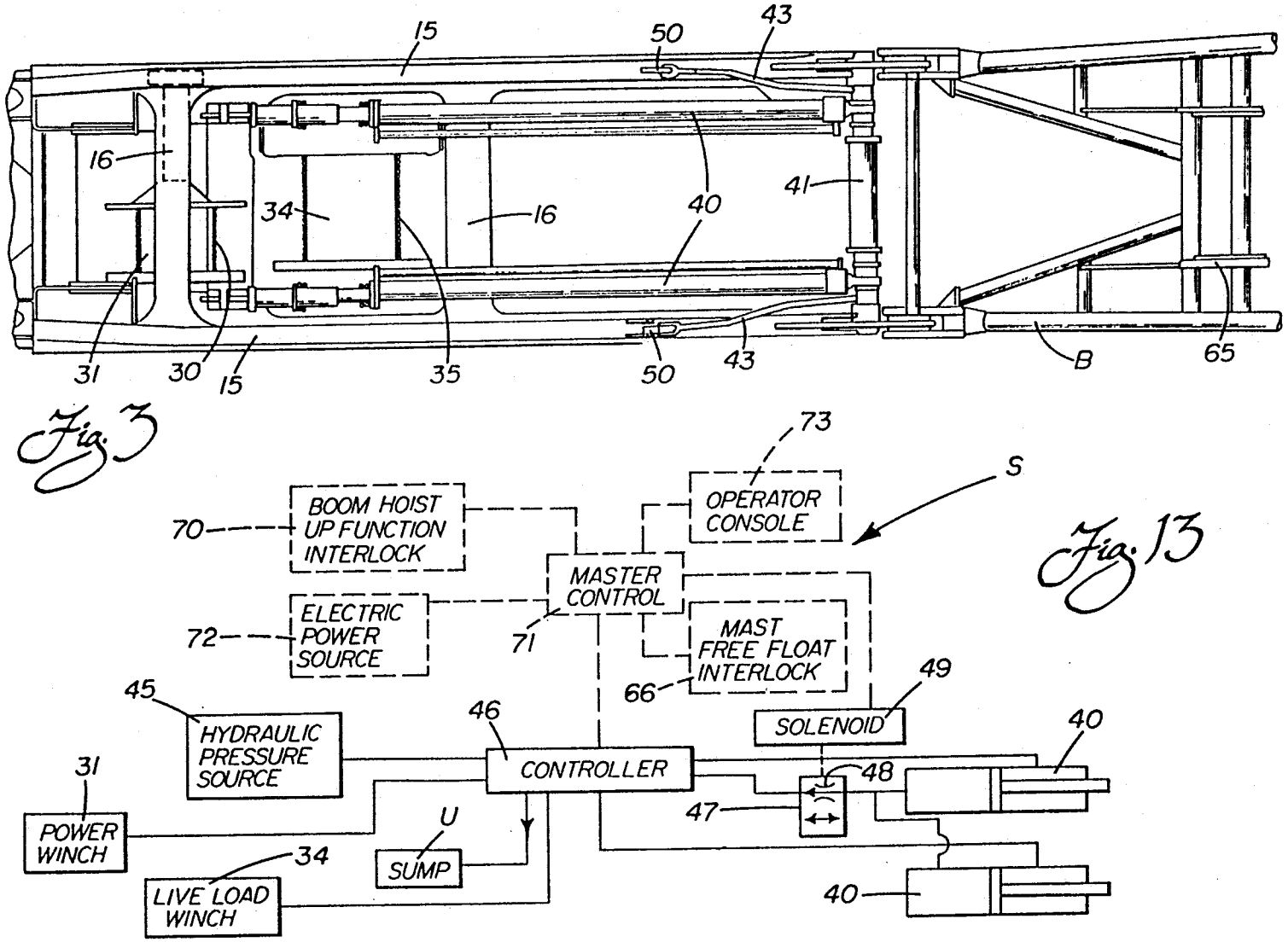
FIG. 3 is a top view illustrating the dual mast and the dual power cylinders on the base unit in a fully retracted position, such as that shown in FIG. 11, and with the lower portion of the boom attached to the base unit.
FIG. 13 is a block schematic diagram of the control system including the electrical and hydraulic control circuits.

The crane 10 comprises a dual, pivoted live mast 15 (see FIGS. 3 and 4 also). The mast 15 includes cross supports 16 and pivot mounts 17. Since the dual masts are thus in effect a single mast unit, reference hereinafter will be to simply the mast 15.

As will be realized, the pivot mounts 17 providing the pivotal mounting are on a base unit 20 that includes a turntable 21 (see FIGS. 1 and 4). The entire base unit 20 is thus mounted for swinging action about a substantially vertical axis defined by the generally horizontal turntable 21 substantially parallel to the ground G (see FIG. 1). The normal operating mode of the crane is with operator cab 22 facing rearwardly with respect to the normal vehicle motion. However, it is readily apparent that the crane 10 operates through a full 360° movement for any desired placement of the load being handled.

The mast 15 may include a fixed length pendant 25 pivotally connected to the top thereof, and to the top of a boom; a lower boom section B only being shown in the drawings (see FIGS. 1 and 3). It is to be understood that additional sections of an operating boom are connected to the boom section B to form a complete structure capable of handling heavy loads at great heights. As is conventional, the boom section B as well as the upper sections, are carried on a separate tractor trailer rig between construction sites.

Figure 11:
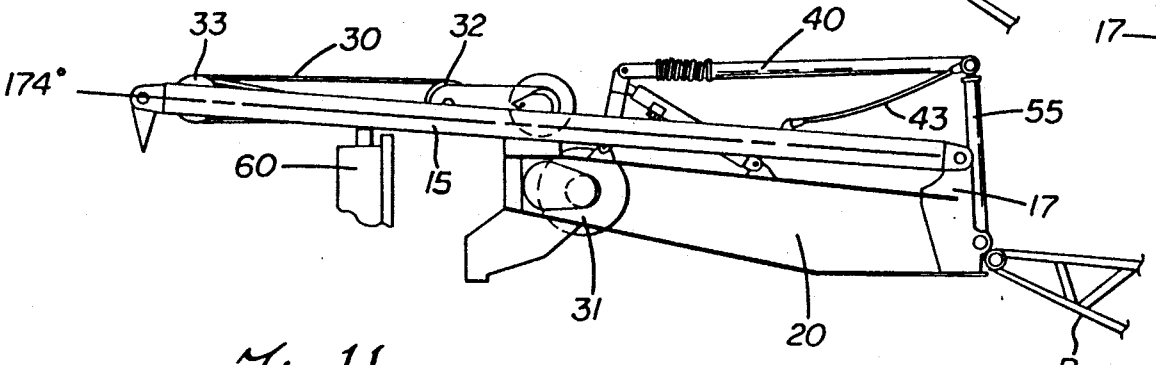

The mast 15 is shown in FIG. 3 in the flipped, stowed position on the opposite side of vertical from the positions of the normal operating mode of the crane 10 (see also FIG. 11). In accordance with a key feature of the present invention, the pivoted mast 15 can be easily and efficiently moved from the normal operating position, such as shown in FIG. 1, to the fully stowed position whereupon the entire vehicle is ready for immediate movement to the next construction site. A necessary counterweight C can remain on the base unit 20 without causing an unbalancing of the loading of axles 13, 14. When the lower boom section B is disengaged and removed, the vehicle is well within the standard length for travel over the road in any jurisdiction. The live mast in the transport mode extends forwardly along the direction of the vehicle movement, that is in a stowed position on the opposite side of vertical from the positions of the normal operating mode (again note FIGS. 3 and 11, for example). Ideally, the tip of the mast 15 extends over the driver cab 12, thus further maximizing the size and load rating of the live mast 15 but at the same time minimizing the overall length of the vehicle.

Figure 10:
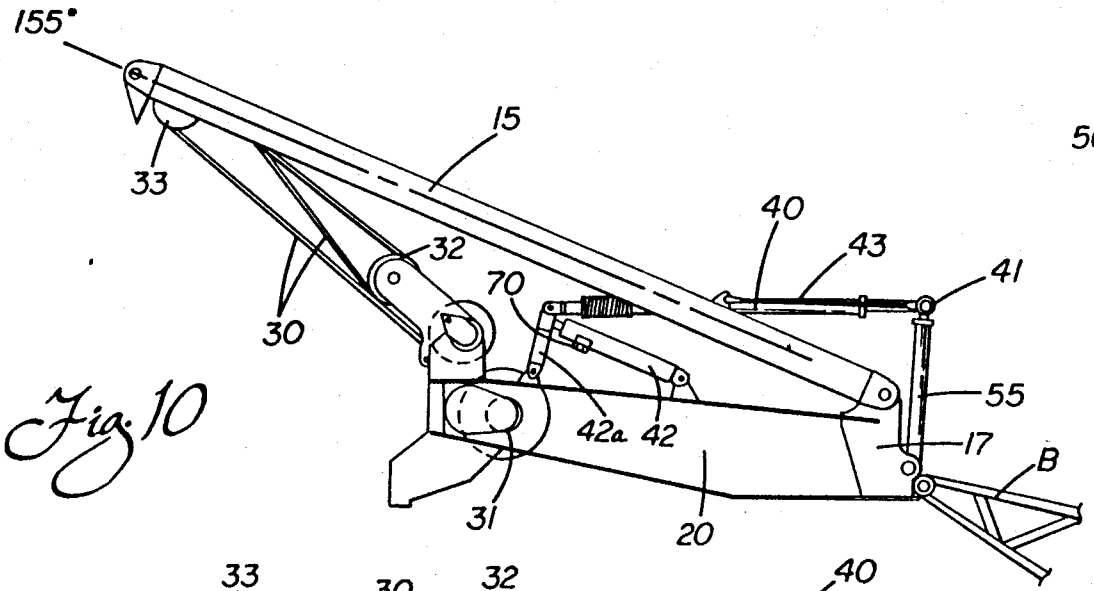
Figure 6:
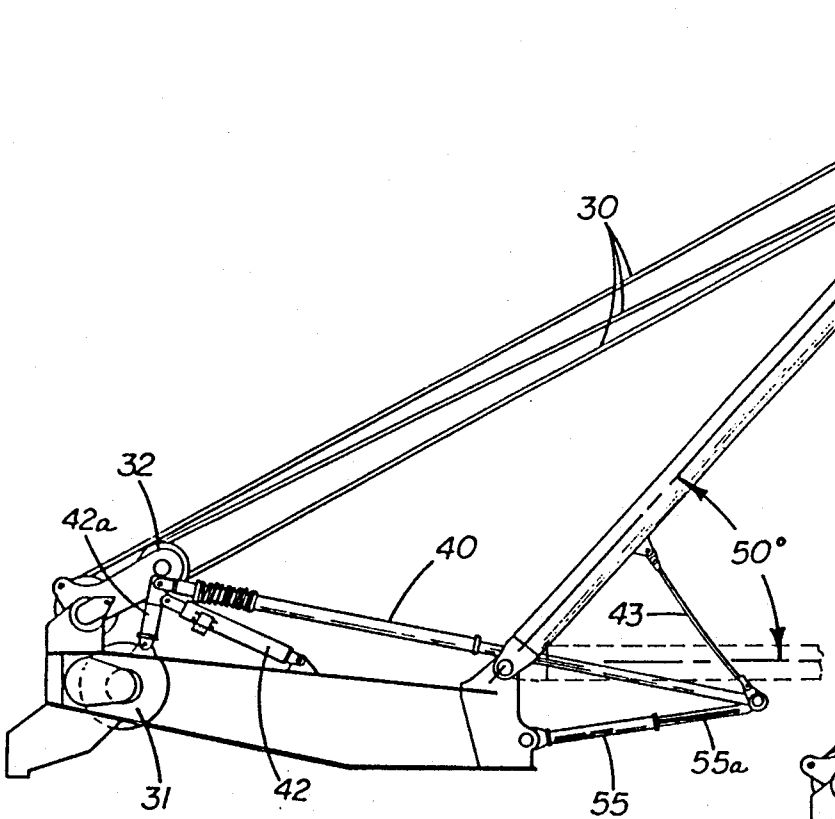

A first power means for operating the mast 15 is a cable and winch combination, shown in the preferred embodiment as power cable 30 and power winch 31 (see FIGS. 3, 6 and 10, for example). Multiple sheave assemblies 32, 33 are illustrated on the base unit 20 and the top of the mast 15 for engagement by the cable 30 to provide multiple passes and thus lift force multiplication. As the winch 31 is operated, the live mast 15 raises and lowers about the pivot mounts 17 during the normal operating mode, and in turn, the boom hoist up and down function is realized. In addition to raising and lowering the mast for the hoist function of the boom, the cable and winch combination 30, 31 serves in a unique manner to move the mast 15 toward the stowed position.

Figure 5:
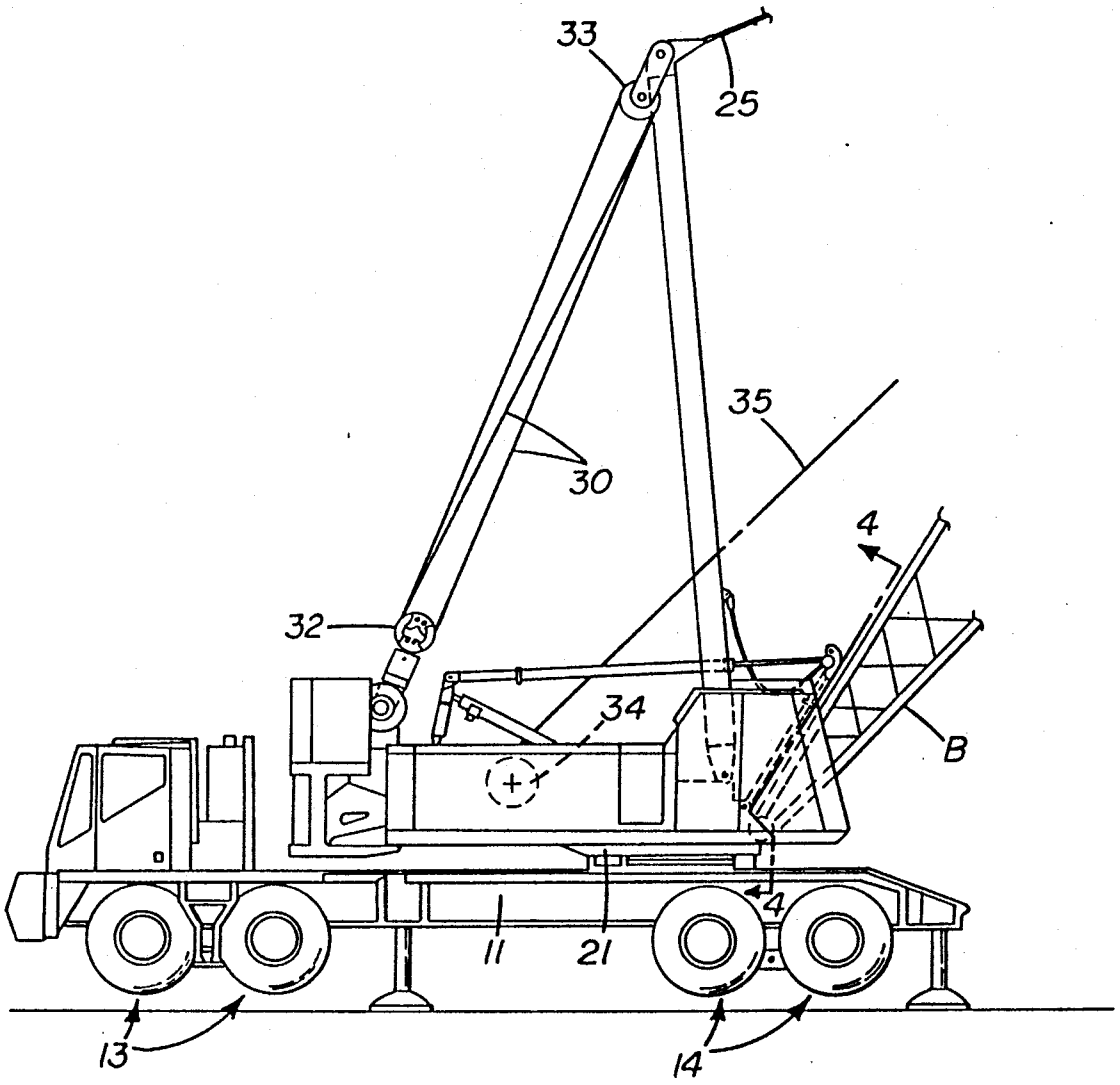
FIG. 5 is a side view of the crane of the present invention with the live load line in place in readiness for normal load lifting operation.
Figure 7:
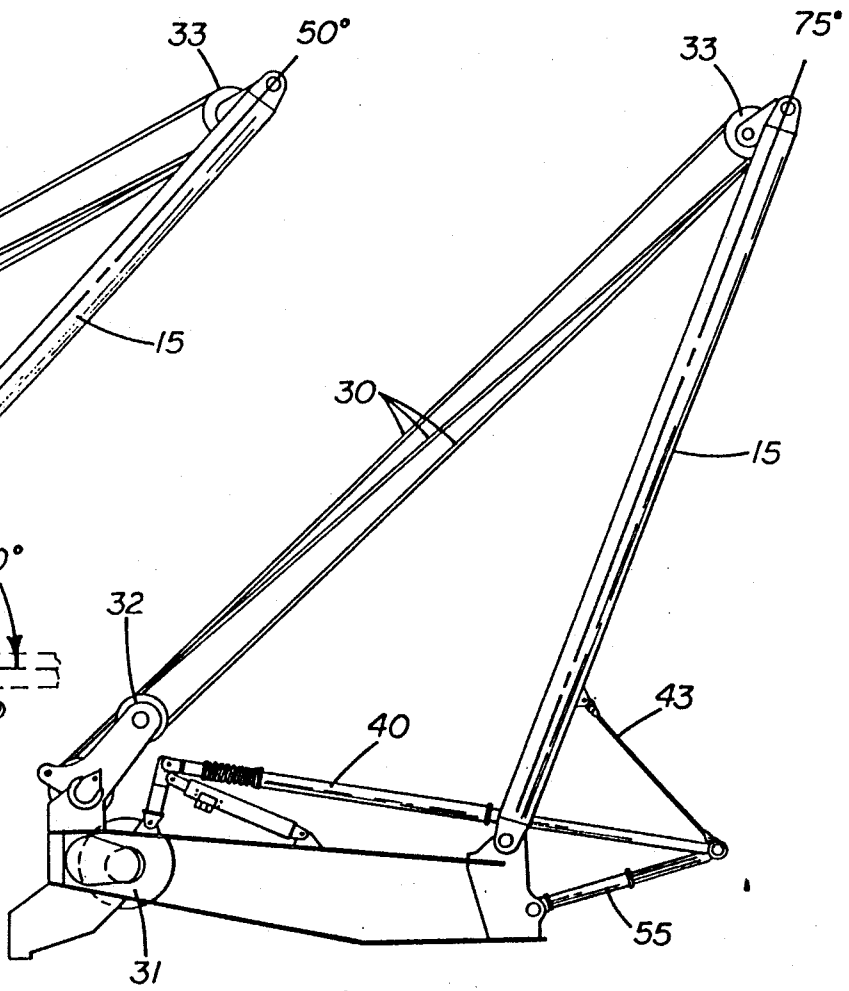

A live load winch 34 is also mounted on the base unit 20 and includes a load line 35 that extends directly to the top of the boom (see FIG. 5). Both the power winch 31 and the live load winch 34 are operated by the control system of the present invention, as shown in FIG. 3, and to be described in detail below.

A second power means engages the mast 15 for operation in the positions of the retraction/erection mode and takes the form (in the preferred embodiment illustrated) of twin or dual hydraulic power cylinders 40. The distal end of the piston rods of the cylinders 40 are connected to a cross bar 41, and the base of the cylinders 40 are pivotally attached to elevated support links 42, 42*a* (see FIGS. 1 and 10).

The power cylinders 40, hereinafter referred to in the singular as power cylinder 40, engage the mast 15 through flexible pendant(s) 43. This engagement is operative to control the mast 14 during the retraction/erection mode thereof. As will be realized, both during normal raising and lowering of the mast 15 for operation of the boom during load handling, and during retraction/erection of the mast 15, the pivot mounts 17 remain attached to the base 20 (see FIGS. 4, 10 and 11).

The second power means includes within the overall control system S of FIG. 13, a hydraulic pressure source 45 operable through controller 46 to actuate the power mast cylinder(s) 40. Counterbalance control means, in the form of valve 47 operates to provide the flow of pressure fluid to and from the extend side of the cylinder 40. A restricted orifice 48 included within the counterbalance valve 47 is operative to provide the cylinder 40 with controlled movement of the mast along the positions of the retraction mode.

More specifically, upon activation of solenoid 49, the restricted orifice 48 is brought into the circuit so as to restrict hydraulic fluid flow from the extend side of the cylinder 40 and thus limit the flow of fluid through controller 46 to sump U. Thus, as the mast 15 is moved to the full retracted position, the restriction of flow from the cylinder 40 provides resistance. The pivotal movement of the mast 15 caused by gravity and/or by operation of the cable 30 and the winch 31, is thus advantageously controlled. In effect, the valve 47 counterbalances the movement of the mast 15 all the way to the full retracted position. On the other hand, when the valve is switched by the solenoid 49, the full flow of fluid is allowed in the opposite direction from the pressure source 45 through the controller 46, then the cylinder 40 is operative to erect the mast 15. In the alternative, in this position the cylinder 40 can be put in the free float mode, as will be explained more in detail later.

The pendant 43 is attached to the mast 15 by first pivot connector 50 (see FIGS. 3 and 4) and to the cross bar 41 by pivot connector 51 As a result, it is apparent that relative angular movement between the cylinder 40 and the 15 is possible. Connected inboard on the cross bar 51 are telescopic guide link(s) 55, pivotally mounted on pivot bar 56 at the base. Extensible portion 55*a* at the top of the guide link 55 is formed as a fork to straddle an internal cross pin 57 (see broken away section in FIG. 4). As will be realized, the extensible portion 55*a* thus provides a telescoping guide link 55 capable of stabilizing the movement of cross bar 41, and in turn cylinder(s) 40 attached to the cross bar through piston rod yoke 58. With this arrangement, a controlled and smoothly operating movement of the mast 15 is assured in response to the combined action of the cable and winch 30, 31 and the power cylinder 40.

The various operating positions of the mast 15 are now apparent, but can be more clearly seen by reviewing in sequence FIGS. 6–11 of the drawings. In these figures, it is assumed that the boom supporting pendant 25 is detached and the boom section B is either lowered as shown in FIG. 1 or completely removed. This leaves the cross bar 41 detached from the boom B (as will be discussed in detail below), and the mast 15 is ready to proceed for stowage.

First, the position in FIG. 6 is established as the start of the stowage action and is approximately 50° from the horizontal position of the mast in the direction of normal crane operation (see dotted line position). At this point, the mast 15 is being lifted and moved toward the stowage position by the cable and winch 30, 31. The pendant 43 is drawn taut and the telescopic guide link 55 is extended to its maximum length.

Figure 7:
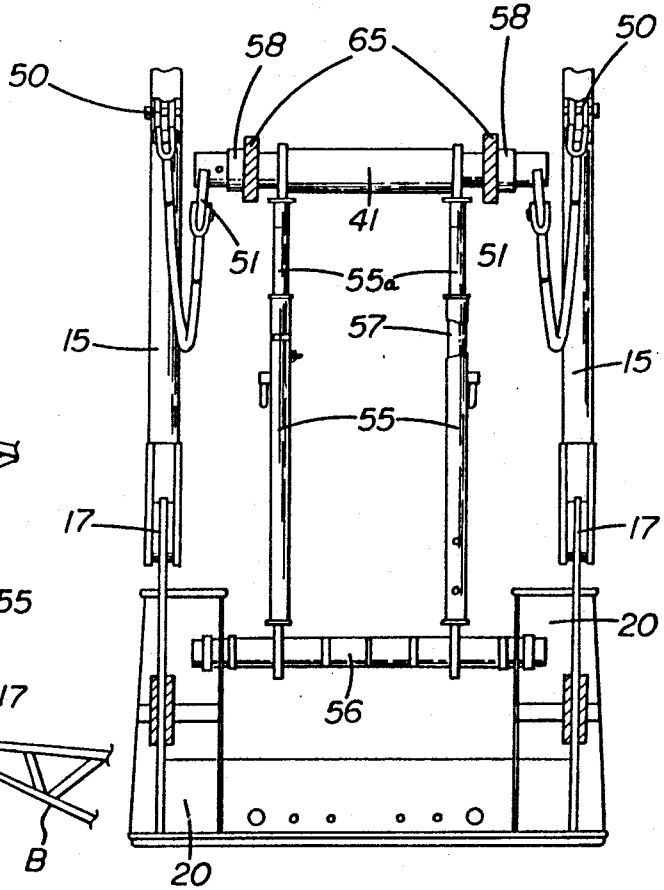
FIGS. 6–11 show in progression the movement of the live mast as controlled by the cable and winch and the power cylinder, namely, at 50° start of the stowage action of the mast, at 75° continuation of movement of the mast toward the stowed position, at 90° or vertical position, at 155° partially retracted/erected position, and at 174°, the fully stowed position.
Figure 8:
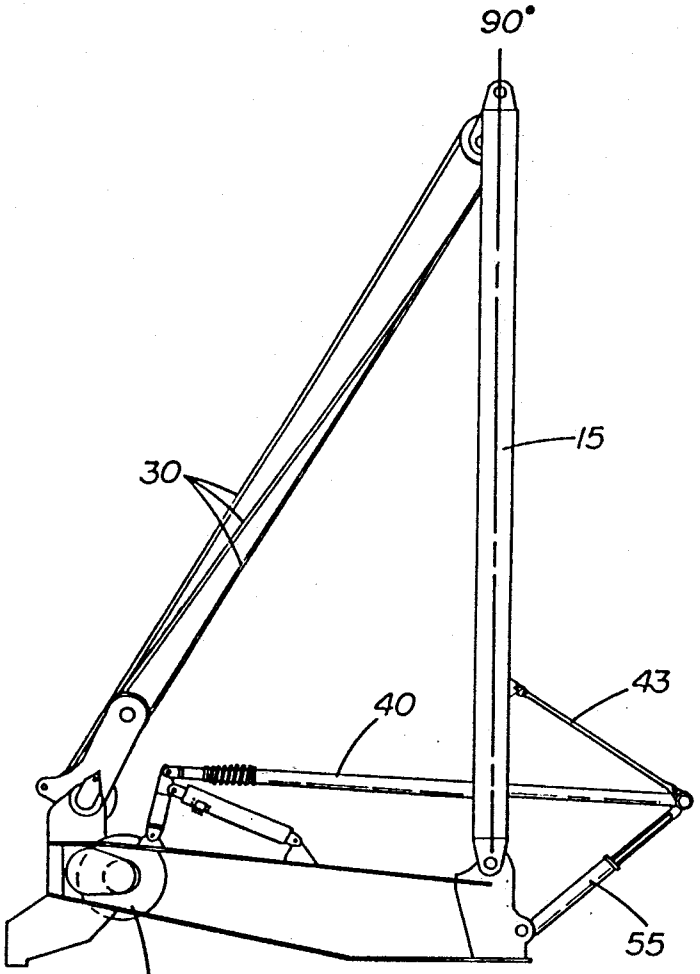

In FIG. 7, the mast 15 continues to be moved by the cable 30/winch 31 to the 75° position maintaining the pendant 43 taut and the telescoping link 55 still at its maximum extended position. In FIG. 8, the cable 30 and winch 31 continue to raise the mast 15 to the vertical position.

Figure 9:
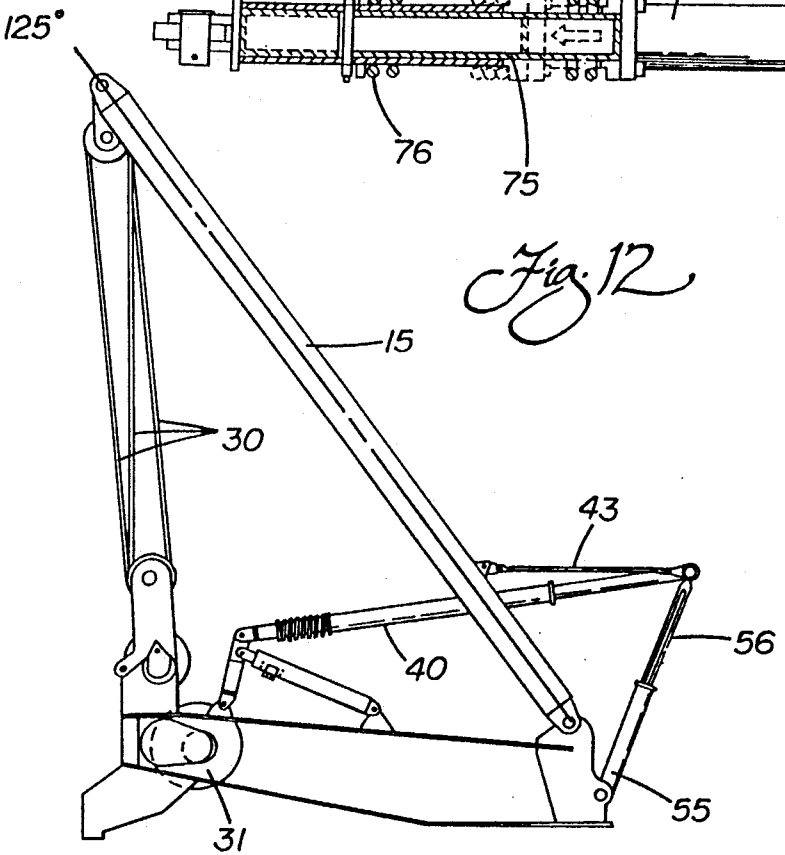

During this sequence, the cylinder 40 continues to decrease in length with hydraulic fluid being forced through the restricted orifice 48 in the counterbalance valve 47. The mast 15 remains steady due to the tautness of pendant 43 and the cylinder 40 continues to be stabilized by the fully extended position of the telescoping guide link 55. As the mast 15 goes over center of the 90° position and moves to the 125° angle, as shown in FIG. 9, the restricted flow of hydraulic fluid from the cylinder 40 continues. This advantageously allows the mast 15 to remain to be controlled, even though at this point substantial gravity forces are acting on it. The operator can maintain tension in the cable 30 through the winch 31, thus continuing to provide controlled lowering of the mast 15. At the 125° position (FIG. 9), the pendant 43 remains taut securely holding back the mast 15 and the stabilizing function of the telescoping guide link 55 continues. From this point on, the forked extension portion 55*a* starts receding back to reduce the length of the telescoping link 55.

The transition to FIG. 10 illustrates the full retraction of the telescoping link 55 while maintaining the tautness of the pendant 43 continuing to controllably hold the mast 15. At the 155° position of FIG. 10 to the approximately 174° angle full stowage position of FIG. 11, the pendant 43 continues to support the mast through its pivoting movement and the telescopic link 55 continues its minimum fixed arc. It will be noted that the pendant 43 crosses over-center of the cylinder 40 at approximately the 155° angle position of FIG. 10. The mast 15 is adapted to rest on support tower 60, just to the rear of cab 12 of the vehicle 12, in the full retracted position. Once in this position, the pendant 43 can go slightly slack (see FIG. 3 also).

For erection of the mast 15, the reverse movement occurs, but with the cylinder 40 providing the lifting and controlling power. With reference back to FIG. 13, the solenoid 49 operates to switch the counterbalance valve to the straight through flow mode and the controller 46 is operated to extend the cylinder 40. As the cylinder extends, the pendant 43 becomes taut and lifts the mast 15 through the phases of FIGS. 11, 10, 9, 8, whereupon the mast 15 is again in the vertical position. While the cable 30 and winch 31 are operated to take up the slack in the cable 30 during this movement, once the mast 15 passes over the 90° center position of FIG. 8, the cable 30 is utilized to control the continued erection movement. In other words, the pressurized extension of the cylinder 40 may continue along with gravity to erect the mast; the cable 30 limiting the movement through the positions of FIGS. 7 and 6.

Figure 2:
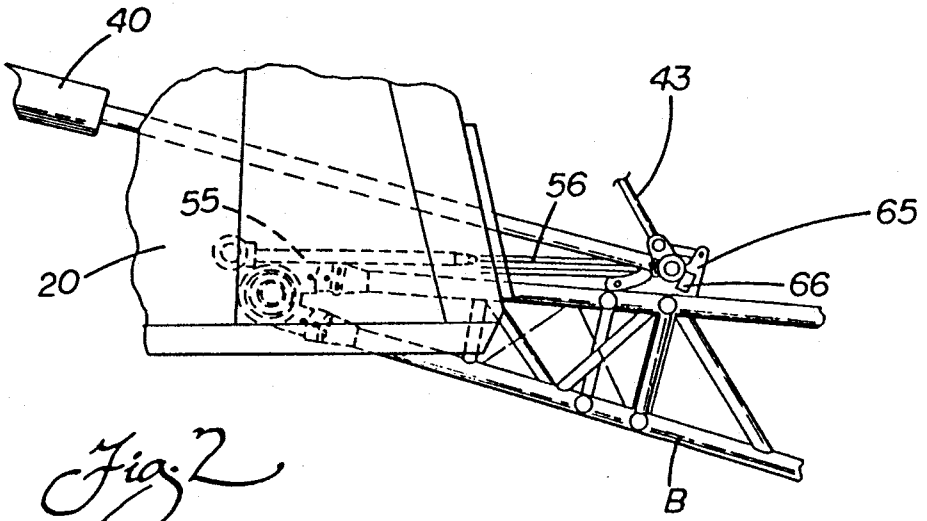
FIG. 2 is an enlarged side detail view of the portion of the boom section closest to the base unit of the crane.

In the position of FIG. 6, the mast is in a normal position to be used for live or direct lifting of loads, such as is necessary with respect to the boom section B to provide attachment to the base unit 20. Once this intermediate stage of use of the mast 15 is completed, the cross bar 41 is attached to the boom section B by a bracket and latch 65 (see FIG. 2). This attachment secures the piston rod of the cylinder 40, the pendant 43 and the extensible portion 56 of the telescoping guide link 55 to the boom for normal crane operation. The electrical control circuit includes master control 71 receiving power from electrical source 72 that provides overall control of the hydraulic controller 46 from operator console 73. A free float interlock microswitch 66 (see FIG. 2) is a part of the control circuit and when actuated provides a signal through the master control 70 to the controller 46 to allow free flow of the hydraulic fluid back and forth to and from the cylinder. In this mode of operation, the pressure source 45, as well as the sump 49 are isolated from the hydraulic fluid of the cylinder 40. This condition provides no positive force or negative resistance to movement.

The boom section B is raised by operation of the cable 30 through the mast 15 and the pendant 43. The remaining sections of the boom are attached, the boom pendant 25 is connected and the crane is ready for normal operation. As the live mast 15 is moved raising and lowering the boom, the flow of hydraulic fluid between the cylinder tends to stabilize the pivoting action and absorb shock. This feature provides an additional advantage to this self-retracting/erecting arrangement of the present invention.

As best shown in FIGS. 10 and 13, another interlock can be provided in the control system S to assure proper operation. This is also incorporated in the electrical control circuit portion of the control system S; namely, a boom hoist up function interlock 70, which may take the form of a microswitch on one of the elevated support links 42. Thus, as the live mast 15 moves through approximately 170° to the full retracted position, the winch 31 is locked out by the controller 46. This prevents inadvertent operation of the winch when the mast 15 is in the fully lowered position and resting on the support tower 60 (see FIG. 11).

Figure 12:
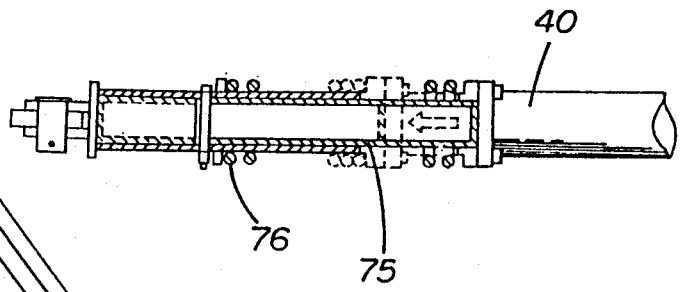
FIG. 12 is an enlarged side view showing the shock absorbing spring mounting of the cylinder.

As best shown in FIG. 12, the cylinder 40 includes telescoping base 75 and compression spring 76. This allows load shock to be absorbed during operation of the crane. Also, as the mast 15 moves through the retraction/erection mode of operation, slight variances in the geometry, such as during cross over of the pendant 43 and the cylinder 40 (see FIGS. 10 and 11) may be accommodated. The compressed position of the spring 76, as shock is absorbed or cross over occurs, is shown in the dotted line outline of FIG. 12.

In the related method of operating the crane 10 and for self-retracting/erecting the live mast 40, reference can once again be made to the figures. In FIGS. 1 and 5, pivotally moving the mast 15 by the cable 30, winch 31 for raising and lowering the mast during the normal operating mode can be realized. Also, after disengaging the cross bar 41 from the boom, the cable 30 and winch 31 are also operative to move the mast 15 toward the stowed position.

The next step is engaging the mast 15 by second power means through the pendant 43 to effect the retraction/erection movement. Counterbalance controlling of the movement is affected through the counterbalance valve 47 restricting flow from the cylinder 40 as the movement of the mast 15 goes through the FIGS. 6 through 11 positions. The cylinder 40 provides in reverse the erecting operation. As a result of the method, the mast 15 may be retracted/erected/operated on a self-contained basis. Advantageously, a separate, attending crane, is not required.

Also in accordance with the method aspects of the present invention, the step of pivotally moving the mast over the FIGS. 6–8 positions is provided by the cable 30 and winch 31, which also provides the power for operating the boom during normal load lifting operations. The step of controlling the movement of the mast is provided in response to the control system S. The counterbalance control is initiated at approximately 50° from the horizontal mast position. From this point through both retraction and erection, the cylinder 40 is operationally effective. During the normal load lifting operation of the crane 10, the method contemplates maintaining the cylinder 40 in a free float operation by the proper positioning of the counterbalance valve 47 to the flow through position.

In summary, the crane 10, incorporating the self-retracting/erecting live mast 15 of the present invention offers substantial results and advantages over the prior art. Utilizing the cable 30 and winch 31 along with the hydraulic cylinder 40 and a simple control system S, the mast 15 can be easily and efficiently retracted/erected/operated on a self-contained basis. No longer is a separate, attendant crane necessary to perform any necessary operations. The crane 10 can be provided to lift maximum loads with the base unit 20 including the counterweight C assuming a travel position, as shown in FIG. 1, wherein the axles 13, 14 are ideally weighted. There is no requirement for swinging the base unit 20 around to the travel position since the mast 15 is simply flipped to the storage position forwardly with respect to the vehicle travel over the cab 12 of the vehicle. The cylinder 40 is attached in a unique manner by the pendant 43 and the telescoping guide link 55, further improving the efficiency of operation. The cross bar 41 is preferably attached through the bracket and latch 65 to the boom section B providing stability during the normal load lifting operation of the crane.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. In combination with a mobile crane with a load handling boom, a self retracting/erecting live mast connected to said boom and with pivotal mounting on a base for boom control, said mast moving to and from a flipped, stowed position on the opposite side of vertical from the positions of the normal operating mode of the crane, comprising:

first power means for raising and lowering the mast about the pivotal mounting during the normal operating mode of the crane up to a substantially vertical position at approximately 90° to said base, and to move said mast through the 90° and toward the stowed position;

second power means independent of said first power means engaging said mast in opposition to said first power means and the force of gravity on said mast for operation in the positions of the retraction/erection mode while maintaining the pivotal mounting; and counter balance control means to cause said second power means to controllably move said mast along the positions of the retraction/erection mode in conjunction with said first power means to and from the stowed positions; whereby said mast may be retracted/erected/operated on a self-contained basis.

2. The crane combination of claim 1, wherein said first power means includes a cable and winch.

3. The crane combination of claim 2, wherein is further provided multiple sheaves on said base and said mast for engagement by said cable to provide lift force multiplication.

4. The crane combination of claim 1, wherein said second power means includes fluid cylinder means, and a pressure source for actuating said cylinder means.

5. The crane combination of claim 4, wherein is further provided flexible means for connecting said cylinder means to said mast to allow relative angular movement during retraction/erection.

6. The crane combination of claim 5, wherein said flexible connecting means comprises a pendant and first and second pivot connectors providing relative flexing at said mast and said cylinder, respectively.

7. In combination with a mobile crane with a load handling boom, a self-retracting/erecting live mast connected to said boom and with pivotal mounting on a base for boom control said mast moving to and from a flipped, stowed position on the opposite side of vertical from the positions of the normal operating mode of the crane, comprising:

first power means for raising and lowering the mast about the pivotal mounting during the normal operating mode of the crane up to a substantially vertical position at approximately 90° to said base, and to move said mast through the 90° and toward the stowed position;

second power means engaging said mast in opposition to said first power means and the force of gravity on said mast for operation in the positions of the retraction/erection mode while maintaining the pivotal mounting;

said second power means comprising a fluid cylinder means and pressure source for actuating said cylinder means;

a flexible means for connecting said fluid cylinder means to said mast to allow relative angular movement during retraction/erection;

said flexible connecting means comprising a pendant and first and second pivot connectors providing relative flexing at said mast and said fluid cylinder;

telescopic guide link means pivotally mounted on said base and attached to said second pivot connector to stabilize said cylinder; and counterbalance control means to cause said second power means to controllably move said mast along the positions of the retraction/erection mode to and from the stowed position;

whereby said mast may be retracted/erected/operated on a self-contained basis.

8. The crane combination of claim 7, wherein the maximum extended length of said link means establishes a maximum fixed arc from approximately 125° to 50° angle from the horizontal position of the mast in the operating mode.

9. The crane combination of claim 8, wherein the minimum length of said link means is provided from approximately 174° angle full stowage position to 155° angle establishing a minimum fixed arc.

10. In combination with a mobile crane with a load handling boom, a self-retracting/erecting live mast connected to said boom and with pivotal mounting on a base for boom control, said mast moving to and from a flipped, stowed position on the opposite side of vertical from the positions of the normal operating mode of the crane, comprising:

first power means for raising and lowering the mast about the pivotal mounting during the normal operating mode of the crane up to a substantially vertical position at approximately 90° to said base and to move said mast through the 90° and toward the stowed position;

second power means engaging said mast in opposition to said first power means and the force of gravity on said mast for operation in the positions of the retraction/erection mode while maintaining the pivotal mounting, said second power means including a fluid cylinder means; and counterbalance control means to cause said second power means to controllably move said mast along the positions of the retraction/erection mode to and from the stowed position, said counterbalance control means including a pressure source for actuating said cylinder means and valve means including in one position a restricted orifice selectively operable to limit hydraulic fluid flow from said cylinder means so as to resist movement of said mast during the retraction mode to provide enhanced control of said mast including with respect to movement by gravity;

whereby said mast may be retracted/erected/operated on a self-contained basis.

11. The crane combination of claim 10, wherein is further provided an electric control circuit including a first interlock means to disable said first power means when said mast approaches said stowed position.

12. The crane combination of claim 11, wherein said electric control circuit includes second interlock means for disconnecting said cylinder means from said pressure source to place said cylinder means in a free-float mode during the normal crane operating mode.

13. The crane combination of claim 12, wherein is further provided latch means for connecting said cylinder means to said boom, said second interlock means including a microswitch adjacent said latch means.

14. The crane combination of claim 1, wherein said mobile crane includes a wheeled vehicle for transport, the loading of the axles of the vehicle being substantially equally distributed in the transport mode with the mast flipped toward the front of the vehicle.

* * * * *